US007588000B2

(12) United States Patent
Crower et al.

(10) Patent No.: US 7,588,000 B2
(45) Date of Patent: Sep. 15, 2009

(54) FREE PISTON PRESSURE SPIKE MODULATOR FOR ANY INTERNAL COMBUSTION ENGINE

(76) Inventors: Harry Bruce Crower, 15737 Lyons Valley Rd., Jamul, CA (US) 91934; Will W. Mathews, P.O. Box 903, Fairacres, NM (US) 88033

( * ) Notice: Subject to any disclaimer, the term of this patent is extended or adjusted under 35 U.S.C. 154(b) by 0 days.

(21) Appl. No.: 11/899,456

(22) Filed: Sep. 5, 2007

(65) Prior Publication Data

US 2008/0053303 A1 Mar. 6, 2008

Related U.S. Application Data

(60) Provisional application No. 60/842,498, filed on Sep. 5, 2006.

(51) Int. Cl.
*F02B 75/04* (2006.01)

(52) U.S. Cl. ..... 123/48 AA; 123/78 AA

(58) Field of Classification Search ..... 123/48 R, 123/48 A, 48 AA, 78 R, 78 A, 78 AA
See application file for complete search history.

(56) References Cited

U.S. PATENT DOCUMENTS 2,914,047 A * 11/1959 Colton ..... 123/48 AA

* cited by examiner

*Primary Examiner*—Noah Kamen
(74) *Attorney, Agent, or Firm*—Donn K. Harms

(57) ABSTRACT

A pressure spike modulator for engagement to the cylinders of an internal combustion engine. The device provides for adjustment of engine cylinder pressures using a reciprocating piston which provides a temporary increase in engine combustion chamber volume. Pressure from combustion chamber gases is communicated by the device back into the combustion chamber during the downstroke of the engine piston. Engine compression and peak combustion pressure may be modulated by adjusting pressure supplied to the device to resist incoming engine gases. Fuels for the attached engine may thereby be varied or substituted by adjusting the engine peak pressure and compression to one adequate for the chosen fuel.

14 Claims, 4 Drawing Sheets

FREE PISTON PRESSURE SPIKE MODULATOR FOR ANY INTERNAL COMBUSTION ENGINE

This application is a continuation-in-part to and claims the benefit of U.S. Provisional Application No. 60/842,498 filed Sep. 5, 2006 and incorporated herein in its entirety by reference.

FIELD OF THE INVENTION

The disclosed device relates to internal combustion engines. More particularly it relates to an apparatus and method engageable either during OEM manufacture or as a retrofit, which provides a secondary pressure chamber as a means to infinitely vary the compression ratio of a communicating engine cylinder and thereby concurrently vary the fuel required to run the engine. Further, the device and method provide a means to modulate the pressure spike occurring during cylinder combustion and particularly during combustion of diesel fuel in an internal combustion engine. Further, when engaged to a gasoline engine, the device and method herein will allow burning of diesel type fuels without reinforcement to the engine structure.

BACKGROUND OF THE INVENTION

Internal combustion engines function by cylinder pressure that is generated by the expansion of the air mixture including nitrogen (4/5 of the air) caused by the fuel combining with the oxygen (1/5) of the air and igniting. This ignition generally produces heat causing the expansion of gasses and the nitrogen portion of the mixture remaining after the combustion. Proper mixture ignition and burning requires the flame propagation to be progressive providing a controlled pressure increase inside the cylinder to avoid destructive pressures that can damage the engine structure.

When seen on a pressure/volume diagram, this internal pressure at near top dead center of the piston in the cylinder is seen as a spike. This peak or spike then trails off as the piston descends in the cylinder expanding the total volume area containing the pressure, thereby lowering it. This progressive flame propagation requires a slower burning fuel which in the case of gasoline is described as the octane rating. In the case of diesel and jet type fuels, which have inherently low octane characteristics and which operate to ignite the fuel with pressure generated in the cylinder, instead of an igniter, a very heavy engine structure is required to accommodate the extreme forces of the "spike" occurring at the start of the combustion process of the in the cylinder. However, in the extreme pressures produced in engines employed in racing conditions (such as tractor pulling contests), such engines are seriously damaged, regardless of the costly heavy duty components employed in the engine to accommodate the pressures anticipated.

Additionally, the high combustion pressures and temperatures in all internal combustion engines conventionally cause air pollution through generation of nitrous oxide created by the ignition process of the fuel and oxygen. Subsequent to ignition, the Nox is exhausted to the atmosphere.

The device and method herein disclosed and described teaches a pressure spike modulator apparatus and method of employment thereof yielding highly improved modulation and control of the compression ratio of an internal combustion engine. It concurrently provides a means to vary the fuel employed to run such engines, enabling the use of lower octane fuels and even pressure ignited diesel fuel in internal combustion piston driven engines.

The device is engageable to existing engines by adapting it to engage in a conventional spark plug, fuel injector, or other port communicating into the cylinder. Or, it may be designed into the engine at manufacture with the device in communication with the cylinder through the cylinder head or wall surface. It is particularly suited to adapt existing gasoline engines to run on diesel, or to adapt piston driven airplane engines using aviation fuel known as "avagas" and having an octane rating of at least 100, to run on diesel, jet fuel, or similar lower octane rated gasoline or fuels thereby increasing the supply of fuels available to such engines.

In this respect, before explaining at least one embodiment of the invention in detail it is to be understood that the invention is not limited in its application to the details of construction and to the arrangement, of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing of other methods and systems for carrying out the several purposes of the present invention. It is important, therefore, that the claims be regarded as including such equivalent construction insofar as they do not depart from the spirit and scope of the present invention.

An object of this invention is the provision of a pressure spike modulating device and method that may be included in new internal combustion engines.

An additional object of this invention is the provision of the pressure spike modulation device and method which may be engaged to existing internal combustion engines.

Yet another object of this invention is the provision of the pressure spike modulation device adapted for engagement to aviation engines to allow their operation on diesel fuel, jet fuel, or diesel fuel.

Another object of this invention is to provide such a pressure spike modulation device that may be easily incorporated into current and future internal combustion engines and manufacturing techniques therefor.

An additional object of this invention is to provide such a pressure spike modulation device and method that will allow internal combustion engines to operate on a wide variety of fuels of varying octane or burn ratings, by providing an infinite adaption of the compression ratio in cylinders of internal combustion engines.

Yet an additional object of this invention is the prevention of pollution of the atmosphere by decreasing the formation of and exhaust of nitrous oxide in internal combustion engines.

These together with other objects and advantages which will become subsequently apparent reside in the details of the construction and operation as more fully hereinafter described and claimed, reference being had to the accompanying drawings forming a part thereof, wherein like numerals refer to like parts throughout.

SUMMARY OF THE INVENTION

The free piston spike modulator and method of use on internal combustion engines herein described and disclosed may be employed to reduce the high pressure spike which occurs upon the ignition of fuel and oxidizer in the cylinder of a conventional internal combustion engine. Those skilled in the art will realized that such a peak or spike in pressure is conventionally graphically depicted in a Pressure/Volume (p/v) diagram. The device herein when engaged in a sealed communication with the upper end of an engine cylinder, absorbs and stores peak pressure and spreads the pressure increase in the engaged cylinder over a wider range, eliminating the need for heavy components such as reinforced pistons, heavy connecting rods, and strengthened crankshafts and crankcases. The device when engaged thereto provides an "elastic" or virtual combustion chamber for gas expansion, without sacrificing performance. When in sealed engagement with engine cylinders, it will allow gasoline engines (such as aircraft requiring high octane fuel) to use diesel fuels, or "Jet A" (commonly available worldwide) in place of gasoline in engine structures of conventional gasoline design using conventionally employed lower weight components. The device and method will also allow higher turbo charging boosts in internal combustion engines using a boosted fuel and oxidizer intake, without exceeding ordinary gasoline cylinder pressures during combustion. This allows for higher boost of the engine output without the extra engine reinforcement normally required.

Still further, the device may be employed as a means to reduce greenhouse gases and air pollution by reducing the Nitrous Oxide formed during conventional cylinder high combustion pressures which conventionally cause more pollution in the atmosphere. When operatively engaged to any cylinder of an internal combustion engine, the device prevents formation of NOX through reduction of the peak cylinder pressures which cause NOX formation. Since Nitrous Oxide is reduced or does not form in the first place during the more even pressures of combustion, there is a resulting significant reduction of Nitrous Oxide in the engine exhaust communicated to the atmosphere. As both a means for fuel adaptation in the engine and a Nox reduction apparatus, the device herein disclosed may be retrofitted on existing engines or installed as a stock component in new engine manufacture.

Further, the device herein also serves to provide a means for an infinitely variable compression ratio when engaged to engine cylinders which is an attribute long sought after by engine designers, especially on throttled spark ignition engines. In such engines, only at full throttle does a throttled spark ignition operate at full efficiency. The device and method herein disclosed provides a means to vary the compression ratio on the engaged engine cylinder by varying the back pressure providing resistance to cylinder pressure communicated to a lower or venting chamber in the disclosed device. By varying the pressure resisting expansion in the venting chamber, a resulting variance of the peak pressure ratio in the communicating combustion chamber occurs.

Details such as the workings of a pressure regulator, fittings, and other items are not shown in order to simplify the general drawings of this invention. However, such components are well known to those skilled in the art to provide a pressurized environment to the high pressure chamber of a reciprocating piston thereby providing resistance to that piston of the device from translating. This effectively increases the venting chamber dimension under pressure from the engaged combustion chamber of the engine cylinder. The pressure in the high pressure chamber of the device provides both resistance and resulting pressure levels in the venting chamber and also a cushion zone preventing the piston of the device from impacting a back wall. Lubrication would also be provided to the device by conventional means such as communication with the engine pressurized oil conduits.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing description and following detailed description are considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

DETAILED DESCRIPTION OF THE INVENTION

Figure 1:
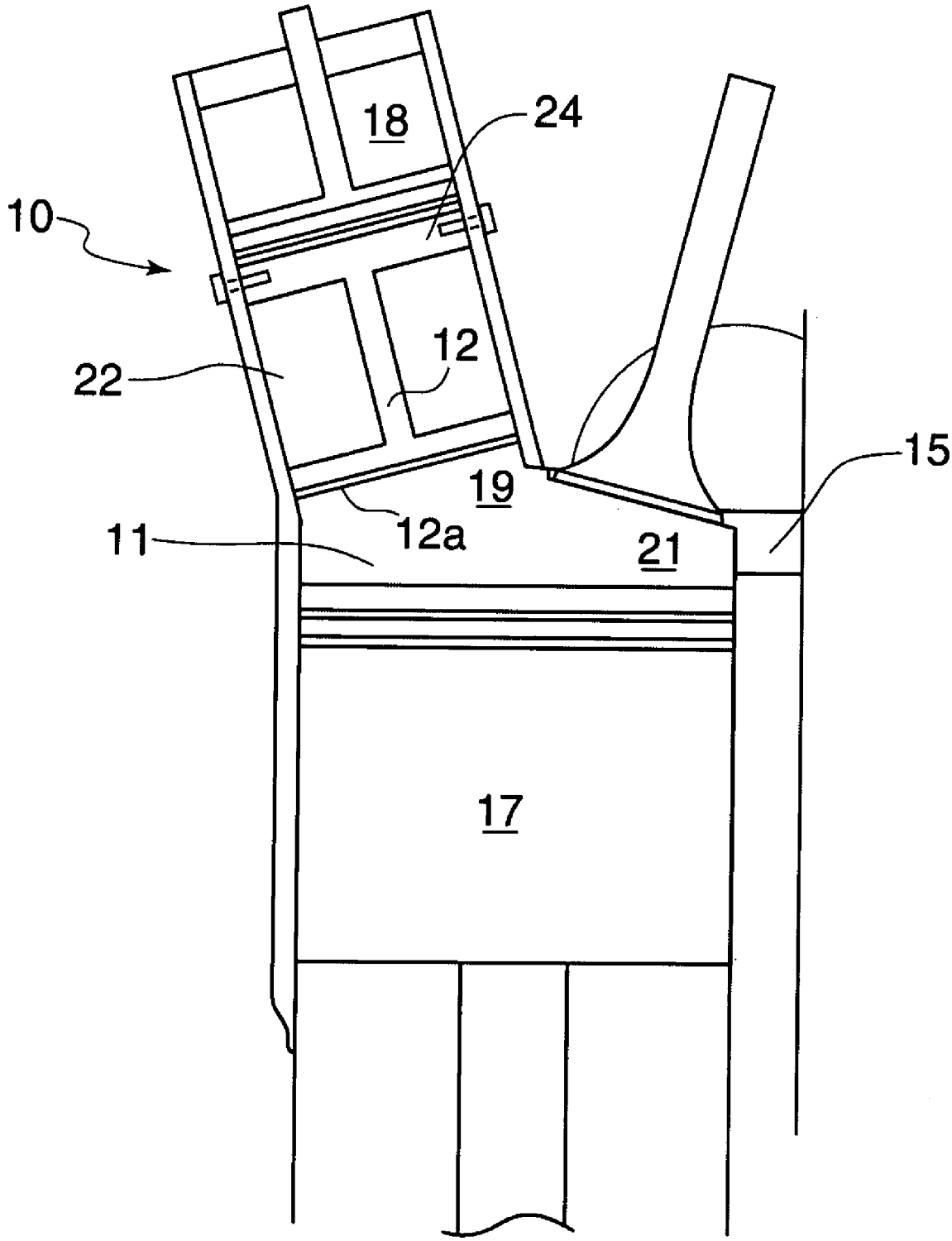
FIG. 1 shows the device engaged and in communication with a cylinder of an internal combustion engine as an addition or OEM.
Figure 2:
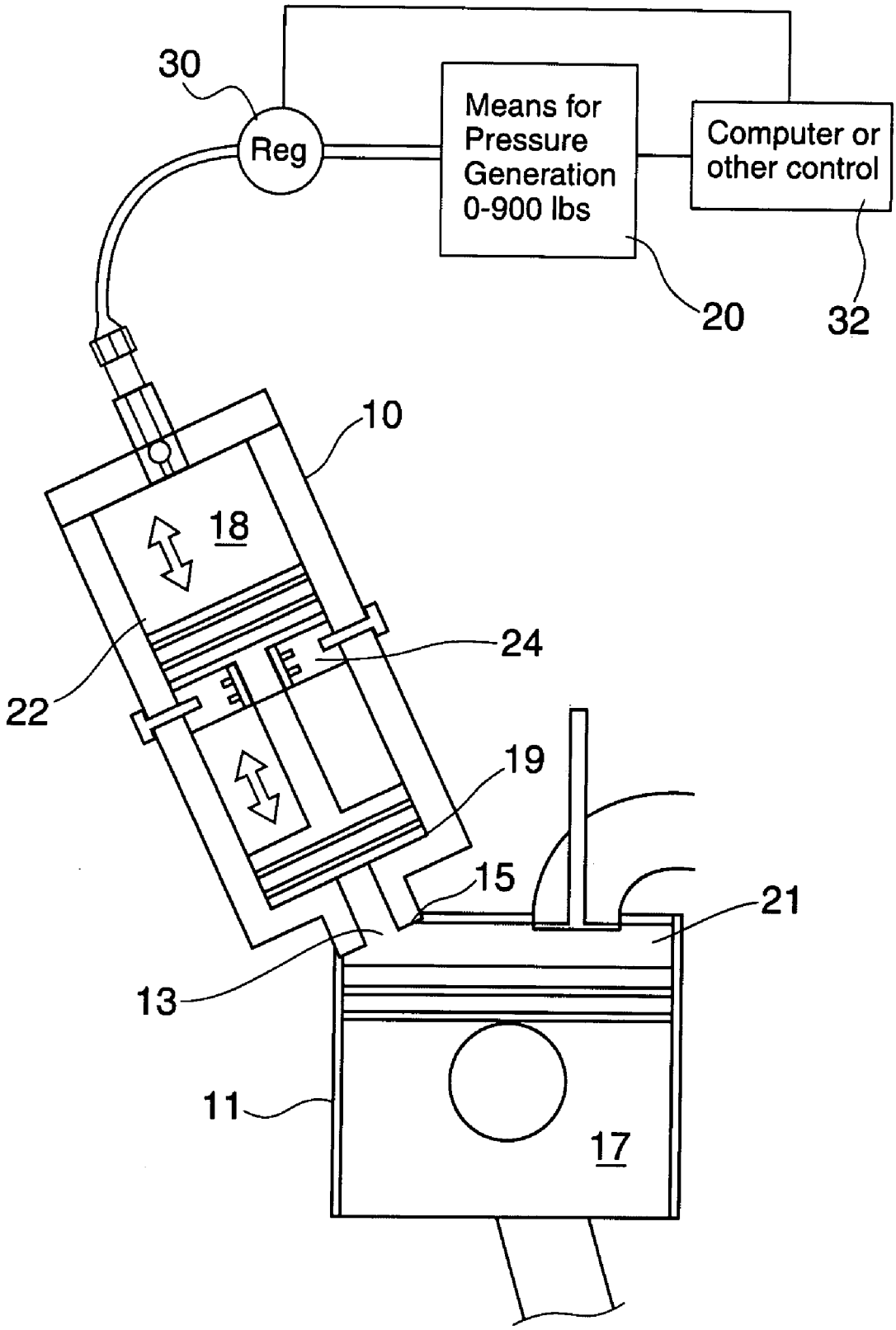
FIG. 2 depicts the device in sealed engagement to a cylinder through the spark plug hole thereby enabling a gasoline engine to operate on diesel fuel in a pressure induced combustion. Also shown are means for communication of high pressure to the high pressure area of the device to change peak pressure.
Figure 3:
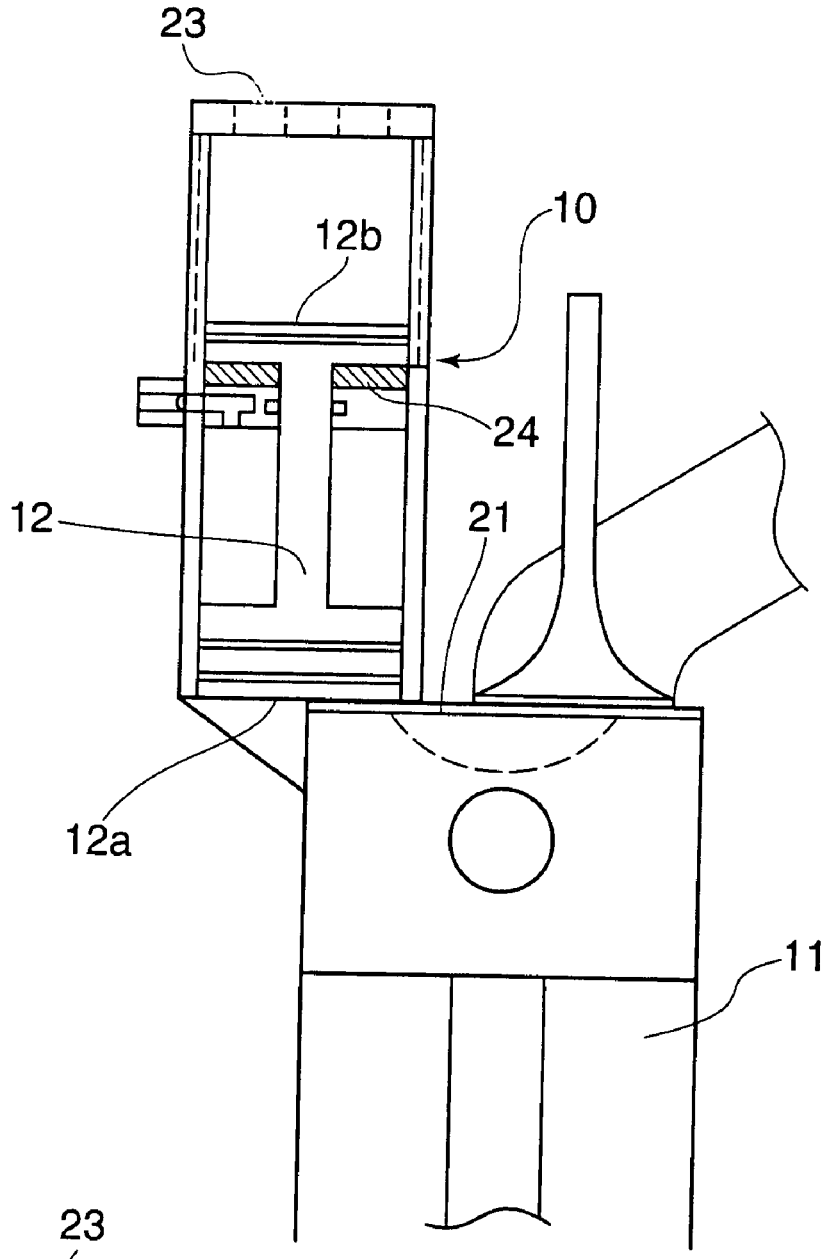
FIG. 3 depicts a mode of the device showing venting of the two portions of the device cylinder.
Figure 3A:
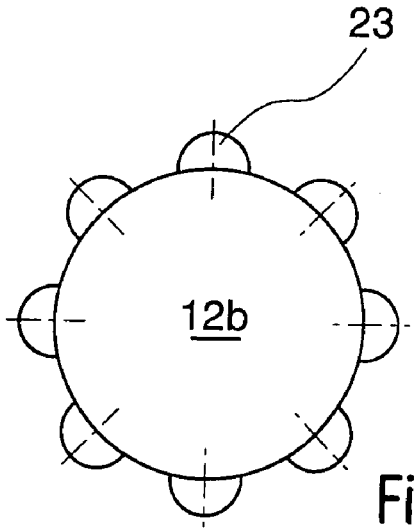
FIG. 3*a* is a top view of the venting that may be employed around the external wall of the cylinder.
Figure 4:
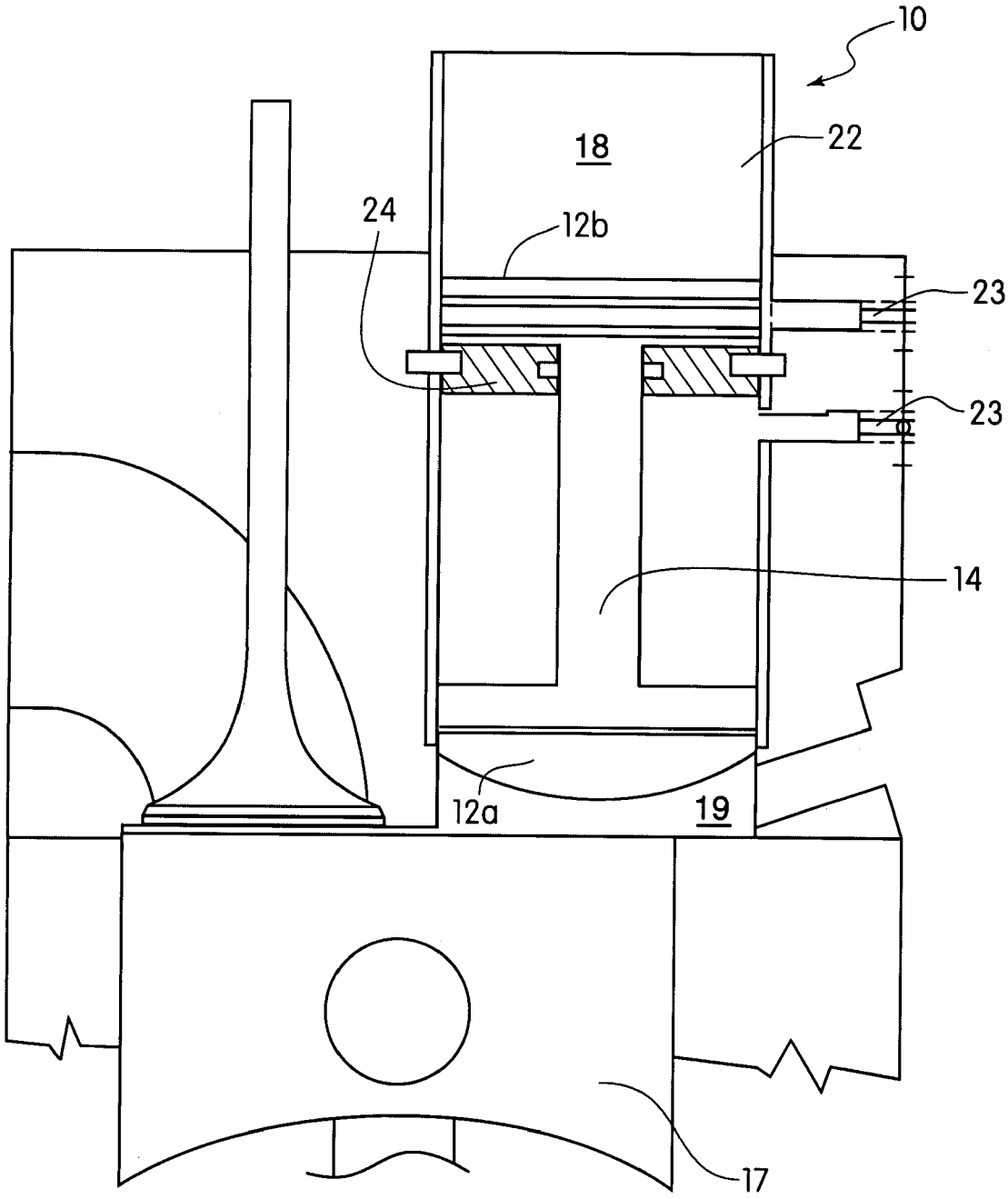
FIG. 4 depicts a particularly preferred mode of the device having a domed head allowing for better clearances of sealing rings and higher compression in the lower cylinder portion.

Referring now to the drawings in FIGS. 1-4, wherein similar parts are identified by like reference numerals, there is seen in FIG. 1, a mode of the device integral in design and as it might be incorporated in a new engine during manufacture. In FIG. 2 the device 10 as it might be employed as a retrofit engaged to the engine cylinder 11 through the spark plug aperture 13 in the cylinder head 15 is depicted. In all modes of the device 10 it will function to modulate the peak engine cylinder 11 pressure to which it is engaged by absorbing and storing cylinder pressure during portions of the engine cylinder stroke, and communicating that pressure back into the cylinder 11 of the engine during each stroke of the engine piston 17.

Combustion commences generally at a time when a lower wall 12*a* of the piston 12 of the device 10 is in a lower position. A biasing is provided by back pressure communicated to the upper wall 12*b* of the piston 12 in the upper chamber 18 of the device 10 from a pump or steam generator, or other means for generation of pressure 20. The upper chamber 18 and lower chamber 19 are separated by a center wall 24 which allows translation of a rod portion 14 of the piston 12. This force maintains the piston 12 at a substantially lower position closest to the engine cylinder 11 until the pressure in the communicating combustion chamber 21 formed by the engine cylinder 11 above the engine piston 17, exceeds the pressure within the upper chamber 18. At this point, the piston 12 translates inside the device cylinder 22 bisected by a center wall 24 toward the upper chamber 18 and provides a means to temporarily increase the volume of the combustion chamber 21 by communicating expanding gases in the combustion chamber 21 for a time period. This temporary expansion of the combustion chamber 21 provides means to control the pressure spike in the combustion chamber 21 at the point of the ignition of fuel and air. Temporarily lowering the compression or pressure at the pressure peak, by temporarily increasing combustion chamber size, thereby eliminates high octane requirements in gasoline engines which currently must match the octane of the fuel to the compression ratio yielding the peak pressure in the combustion chamber 21 to avoid pre-ignition.

Further, such engines as they increase the power and compression of the fuel and air combusted in the combustion chamber 21 must have increasingly heavy and sturdier structural components to communicate that power to the vehicle without damage to moving structural components of the engine. This is particularly true in high compression racing gasoline engines with blowers or other means for pressurized fuel mixture input, and as required by diesel engines which employ a very high compression of the fuel mixture in the combustion chamber to increase temperatures therein sufficiently to ignite the fuel mixture.

When engaged to a gasoline engine through the spark plug hole, or a fuel injector aperture, or as original equipment with formed engine block or head passages, the device 10 will allow the use of diesel fuel in the engaged cylinder 11 thereby converting it to a diesel engine without the conventional requirement for a heavy and strengthened engine structure. This is accomplished from the temporary relief of peak pressure at the pressure spike point of ignition and subsequent communication of stored pressure and energy back to the expanding compression chamber 21 as the engine piston 17 moves away from the device 10.

In operation engaged to the combustion chamber 21 portion of the cylinder 11 of any gas or diesel engine, once a peak pressure in the combustion chamber 21 is reached, which is substantially equal to that of the upper chamber 18 of the device, the communicated gas and pressure in the lower chamber 19 is forced back into the combustion chamber 21. This is caused when the piston 12 in the device 10 moves downward away from the pressurized upper chamber 18 by the higher force of pressure in that chamber caused when the piston 12 is driven toward the upper chamber 18 by gasses from the engine combustion chamber 21.

Subsequently the gases stored under pressure in the lower chamber 19 is forced by the higher pressure in the upper chamber 18, back into the combustion chamber 21. This particularly enhances performance since it provides continued even pressure and force to the engine piston 17 of the communicating cylinder 11 to continue to drive the engine piston 17 downward. This is unlike conventional operation where pressure in the combustion chamber peaks and then drops dramatically as the size of the combustion chamber increases.

In operation the pressure of gasses in the upper chamber 18 provides means to resist movement of the piston 12 and a resulting increase in the volume into which exploding fuel mixtures in the combustion chamber 21 may expand. Thus, a unique and novel ability is provided through the increasing and decreasing of the pressure in the upper chamber 18. Increasing the pressure in the upper chamber 18 will cause the piston 12 to begin to translate toward the upper chamber 18 at a higher pressure and raise the resulting peak pressure in the cylinder combustion chamber 21. Conversely, lowering the pressure of the upper chamber will cause an earlier piston 12 translation resulting in an earlier expansion of the effective volume of the combustion chamber 21, and lowering the peak pressure in the combustion chamber 21. Thus, by regulating the pressure of the upper chamber 18, the compression ratio and volume of the combustion chamber 21 available to expanding gasses may also be adjusted. Pressure to the upper chamber 18 is provided by means for pressure generation such as an air pump engaged to the engine, or steam produced using engine exhaust heat and water. The resulting pressurized gas is fed to the upper chamber 18. A regulator 30 operatively engaged to a means for control such as an electronic control 32 that operates the regulator 30 to maintain a desired pressure in the upper chamber 18 to yield the peak pressure in the combustion chamber 21 desired.

The device 10 and method of employment thus provides a means to make an internal combustion engine operate on any octane gasoline without pre-ignition by adjusting the upper chamber 18 pressure to yield a correct peak pressure for the fuel. Infinite adjustability of the peak pressure and compression ratio of the engine combustion chambers 21 may be obtained by varying the pressure of the upper chamber 18.

The device 10 thus also provides a means for increasing the volume for expansion of exploding fuel mixtures in the compression chamber 21 and means to store the energy thereof by compressing the gas stored in the upper chamber 18 to thereafter expand and force the piston 12 to communicate the gas back into the combustion chamber 21 under force during the stroke of the piston 17 therein. This variable expansion of the combustion chamber 21 by the translating piston 12 of the engaged device 10, and the storage of energy from the exploding fuel mixture by compression in the high pressure upper chamber 18, and communication thereof back to the combustion chamber 21, also provides means for control of or elimination of the pressure spike which exists in all such internal combustion engines close to the time of detention of the fuel and air mixture in the combustion chamber 21. As such, a much smoother power stroke of the engine piston 17 is yielded by more constant communication of an even force over time from the stored energy in the device 10, back into the combustion chamber 21 as it is increasing in volume.

The use of a means for pressure generation and means to regulate the pressure in the upper chamber 18 allows the user to adjust the device to accommodate many types of fuel in the engine to which it is engaged. For instance, a piston driven airplane that runs on high quality aviation gas could use jet fuel or other fuels if needed by adjusting the pressure in the upper chamber 18 and thereby the peak pressure in the engine combustion chamber 21. Vents 23 communicate with the chambers 18 and 19 for venting of gas during their reciprocation.

While all of the fundamental characteristics and features of the method and apparatus for modulation of the pressure spike occurring in internal combustion engine cylinders has been described herein, with reference to particular embodiments thereof, a latitude of modification, various changes and substitutions are intended in the foregoing disclosure and it will be apparent that in some instance, some features of the invention will be employed without a corresponding use of other features without departing from the scope of the invention as set forth. It should be understood that such substitutions, modifications, and variations may be made by those skilled in the art without departing from the spirit or scope of the invention. Consequently, all such modifications and variations are included within the scope of the invention as defined herein.

What is claimed is:

1. A pressure spike modulator for sealed engagement to the combustion chamber of a piston driven internal combustion engine, comprising:

a cylinder defined by a sidewall;

a piston having a first wall on a first end and having a second wall on a second end, said piston having a circumference adapted to reciprocate in said cylinder;

a first chamber of said cylinder defined by an area between said sidewall and said first wall;

a second chamber in said cylinder defined by a second area between said sidewall and said second wall;

said first chamber and said second chamber separated by a center wall communicating between said sidewall;

said first wall and said second wall of said piston connected by a member communicating through said center wall;

means for sealed engagement of said first chamber in a communication with a combustion chamber of a piston-driven internal combustion engine;

means to pressurize said second chamber to a first pressure level; and said first pressure level determining a peak pressure achievable in said combustion chamber prior to said peak pressure causing a translation of said piston toward said second chamber and away from said first chamber.

2. The pressure spike modulator of claim 1 additionally comprising:

means to regulate said first pressure level to a chosen said first pressure level in a range of pressure levels and thereby regulate said peak pressure.

3. The pressure spike modulator of claim 2 wherein said means for sealed engagement of said first chamber in a communication with a combustion chamber is a threaded engagement with a spark plug hole of said internal combustion engine.

4. The pressure spike modulator of claim 2 additionally comprising:

a first portion of said first chamber defined by an area between said center wall and said first wall; and means to vent said first portion of said first chamber.

5. The pressure spike modulator of claim 4 wherein said means for sealed engagement of said first chamber in a communication with a combustion chamber is a threaded engagement with a spark plug hole of said internal combustion engine.

6. The pressure spike modulator of claim 2 wherein said means to regulate said first pressure level comprises:

a regulator positioned between a flow of pressurized gas from said means to pressurize said second chamber, and said second chamber; and said regulator having a set point ceasing flow of said pressurized gas once a determined said first pressure level is reached in said second chamber.

7. The pressure spike modulator of claim 6 additionally comprising:

a first portion of said first chamber defined by an area between said center wall and said first wall; and means to vent said first portion of said first chamber.

8. The pressure spike modulator of claim 6 additionally comprising:

said regulator adjustable to a range of said set points;

a controller engaged with said regulator; and said controller being user-adjustable to any set point in said range of set points to thereby provide means to vary said first pressure level.

9. The pressure spike modulator of claim 8 additionally comprising:

a first portion of said first chamber defined by an area between said center wall and said first wall; and means to vent said first portion of said first chamber.

10. The pressure spike modulator of claim 1 additionally comprising:

a first portion of said first chamber defined by an area between said center wall and said first wall; and means to vent said first portion of said first chamber.

11. The pressure spike modulator of claim 1 wherein said means for sealed engagement of said first chamber in a communication with a combustion chamber is a threaded engagement with a spark plug hole of said internal combustion engine.

12. A method of regulating the peak pressure achievable in the combustion chamber of an internal combustion engine using an engageable cylinder defined by a sidewall and having a first chamber defined by an area between said sidewall and a first wall of a reciprocating piston and having a second chamber in said cylinder defined by a second area between said sidewall and a second wall of said piston opposite said first wall, and having said first chamber and said second chamber separated by a center wall communicating between said sidewall and having said first wall and said second wall of said piston connected by a member communicating through said center wall and a having a means for sealed engagement of said first chamber in a communication with said combustion chamber, means to pressurize said second chamber to a first pressure level, comprising the steps of:

engaging said first chamber in said sealed engagement with said combustion chamber; and pressurizing said second chamber to said first pressure level to thereby set said peak pressure achievable in said combustion chamber.

13. The method of claim 12 including the steps of:

ascertaining a fuel pressure level for a fuel for said internal combustion engine which avoids a pre-detonation of said fuel; and setting said first pressure level at or below said fuel pressure level.

14. The method of claim 13 including the steps of:

ascertaining said fuel pressure level when said fuel is diesel fuel;

setting said first pressure level at or below said fuel pressure level for said diesel; and running a said internal combustion engine designed for gasoline fuel using said diesel fuel.

* * * * *